US005730322A

United States Patent [19]

Iba et al.

[11] Patent Number: 5,730,322

[45] Date of Patent: Mar. 24, 1998

[54] MULTIPLE FLOW VOLUME DISPENSING CAP

[75] Inventors: Wayne S. Iba, Mission Viejo; Laurie C. Grau, Aliso Viejo, both of Calif.

[73] Assignee: Allergan, Waco, Tex.

[21] Appl. No.: 578,506

[22] Filed: Dec. 26, 1995

[51] Int. Cl.[6] ..... B67D 37/00

[52] U.S. Cl. ..... 222/42; 222/481; 222/548; 222/212

[58] Field of Search ..... 239/394, 436; 222/42, 142.9, 480, 481, 548, 212

[56] References Cited

U.S. PATENT DOCUMENTS

| | | | |
|---|---|---|---|
| 3,042,273 | 7/1962 | Bauer et al. | 222/548 |
| 3,059,816 | 10/1962 | Goldstein | 222/109 |
| 3,076,573 | 2/1963 | Thomas | 215/6 |
| 3,083,872 | 4/1963 | Meshberg | 222/42 X |
| 3,170,633 | 2/1965 | Castelli | 239/436 X |
| 3,220,619 | 11/1965 | Lodding et al. | 222/416 |
| 3,262,606 | 7/1966 | Waterman | 222/153 |
| 3,263,873 | 8/1966 | Armour | 222/548 X |
| 3,447,725 | 6/1969 | Armour | 222/486 |
| 3,655,102 | 4/1972 | Moran | 222/484 |
| 4,157,768 | 6/1979 | Britt | 222/42 |
| 4,545,508 | 10/1985 | Crib, Jr. et al. | 222/153 |
| 4,699,299 | 10/1987 | Gach | 222/480 |
| 4,717,050 | 1/1988 | Wright | 222/482 |
| 4,739,906 | 4/1988 | Lo Turco | 222/153 |
| 4,754,898 | 7/1988 | Britt et al. | 222/487 |
| 4,792,054 | 12/1988 | Weidman | 222/23 |
| 4,813,577 | 3/1989 | Carow | 222/486 |
| 4,832,219 | 5/1989 | Nycz | 215/235 |
| 4,903,870 | 2/1990 | LaVance | 222/482 |
| 4,917,271 | 4/1990 | Kanner et al. | 222/189 |
| 5,123,574 | 6/1992 | Poulos | 222/362 |
| 5,147,072 | 9/1992 | Dirksing | 222/212 |
| 5,246,145 | 9/1993 | Leoncavallo et al. | 222/153 |
| 5,290,258 | 3/1994 | Ennis, III et al. | 222/548 X |
| 5,366,115 | 11/1994 | Kersten et al. | 222/212 X |
| 5,383,582 | 1/1995 | Baxer et al. | 222/480 X |
| 5,409,145 | 4/1995 | Payne | 222/212 |

FOREIGN PATENT DOCUMENTS

| | | | |
|---|---|---|---|
| 128 693 | 6/1950 | Sweden | 239/394 |
| 2 091 232 | 7/1982 | United Kingdom | 222/480 |

*Primary Examiner*—Kenneth Bomberg
*Attorney, Agent, or Firm*—Walter A. Hackler

[57] ABSTRACT

A multiple flow volume dispensing cap is provided which generally includes a bottom portion for attachment to a squeezable container for holding a sterile solution, such as a contact lens solution, an orifice in the bottom portion for enabling fluid flow therethrough, and a top portion having multiple conical members projecting therefrom. The top portion is rotatably mounted to the bottom portion by means of a centrally disposed pin protruding from the bottom portion. Each conical member includes a flow passage for enabling solution to be dispensed in a direct stream or in droplets. By rotating the top portion about the pin, such that a selected conical member is aligned with the orifice, a user of the device can select the fluid flow rate and flow direction that is needed to accomplish a particular task. A lid may be provided which includes annular members configured to engage the conical members in order to prevent contamination of the sterile solution. The annular members provide an air tight seal without contact between dispensing ends of the conical members and the lid.

17 Claims, 2 Drawing Sheets

MULTIPLE FLOW VOLUME DISPENSING CAP

The present invention generally relates to dispensing caps for liquids stored in containers and more particularly relates to a multiple flow volume dispensing device for dispensing liquids, for example contact lens solutions, at different rates of flow.

Liquids, for example solutions for cleaning and conditioning contact lenses, have conventionally been stored in manually squeezable containers from which a user can dispense the stored solution through a nozzle projecting from a cap. The same bottle of solution may be used for both cleaning and soaking contact lenses. Typically, lenses are cleaned by directing a stream of solution from the squeezable bottle directly onto the contact lens. Furthermore, it is sometimes desirable to apply a single drop of solution on the contact lens before the lens is placed on the eye. For these purposes, nozzles on conventional bottles are narrow and tapered in order to enable a user to dispense the solution in a direct and precise stream, or in singular drops.

It is often recommended that contact lenses be soaked in a tray filled with solution when the lenses are not in use, for example overnight. For this purpose, after rinsing the lenses with a stream of fluid, the user will typically seal the nozzle and then proceed to unscrew the cap from the container in order to pour, rather than squirt the fluid from the container into the soaking tray. Unscrewing the cap presents some risk. Particularly, if a person is not careful or lacks manual dexterity, the bottle could be toppled in the process, thus spilling the contents.

Although it is possible for a person to fill a soaking tray by means of the narrow nozzle thus avoiding the steps of sealing the nozzle and unscrewing the cap, this approach is impractical at best, as more time is required to dispense the liquid through the relatively narrow orifice. Furthermore, if the bottle is squeezed too vigorously, the resulting force of the narrow stream may cause excess splashing and waste of the solution, or possibly may cause the cap to burst, resulting in loss of bottle contents.

The present invention provides a cap having multiple nozzles for enabling dispensing of solution at different rates without the need to unscrew the entire cap from the container.

Several prior art devices have been developed which are directed at enabling the dispensing of liquids or solids at different rates from a single cap. For example, containers for culinary spices may include a cap that has an perforated opening on one side for enabling shaking of spices from the container, and a single wide opening on an opposite side for enabling spices to be spooned or poured from the container.

In addition, U.S. Pat. No. 4,717,050 to Wright discloses a multiple orifice dispensing closure for dispensing a product at different flow rates. However, this structure will not lend itself to enabling the opening of one orifice while preventing the inadvertent opening of the other orifice. As a result, a person might open a first orifice configured for dispensing a large stream of fluid, while believing he has opened a second orifice configured for dispensing a fine stream of fluid. In the case of a contact lens wearer, this prior art design may result in a contact lens being sprayed too harshly by means of the unintended nozzle, thus causing the lens to fall and become lost.

U.S. Pat. No. 4,699,299 to Gach discloses an adjustable dispensing closure for a container for dispensing products therein at controlled rates which comprises a closure body with a single opening therein and a rotating cap member having several differently sized apertures therein. However, this device is not suitable for dispensing precisely directed streams of fluid at different rates of flow.

Furthermore, the Gach device is not adapted for maintaining sterility of container contents, and thus is less than ideal as a cap for a container of contact lens solution, which necessarily must be maintained clean and free from contaminants for hygienic and safety reasons. Particularly, the design of this prior art device does not include a means for maintaining sterility of the product when the product is not in use.

The present invention addresses the problems discussed above that have been left unsolved by prior art devices. The present invention provides a multiple orifice cap device adapted for particular use with containers of sterile solutions and which is adapted for dispensing such solutions in precisely directed streams and at different rates of flow.

SUMMARY OF THE INVENTION

A multiflow dispensing cap in accordance with the present invention generally includes a bottom portion having means for attaching said bottom portion to a manually squeezable container for holding a fluid. Means, defining an orifice in said bottom portion, are provided for enabling fluid flow therethrough upon squeezing of the container.

A top portion, having a nozzle comprised of a plurality of conical members, is rotatably mounted to the bottom portion. Rotatable mounting between the top portion and bottom portion may be provided by means of a pin protruding from the bottom portion, and further by means of a ring member encircling the bottom portion and engaging a complementary groove within the top portion.

Importantly, the top portion nozzle provides means for both determining fluid flow rate from the dispensing cap and for forming a directed stream of fluid from the dispensing cap. Upon rotation of the top portion about the pin, a user of the present invention may align a selected conical member with the bottom portion orifice such that upon squeezing of the container, fluid within the container will flow though both the bottom portion orifice and the selected conical member, and be dispensed in a precise stream defined by dimensions of the selected conical member. A visual, palpable and/or audible indicator provides means for assuring proper alignment of the selected conical member with the bottom portion orifice. Means are provided for facilitating alignment between a selected conical member and the bottom portion orifice.

In addition, one embodiment of the present invention includes a lid, removably engaged to the top portion, which provides means for preventing contamination of the conical members. Preferably, the lid is adapted to engage with the conical members by means of shoulders, for example annular members, depending from the lid. The shoulders provide a leak proof seal between the conical members and the lid without contact between the dispensing ends of the conical members and the lid.

The present invention is ideal for storage and dispensing of sterile solutions, such as contact lens solutions. Thus, in a broad sense, the present invention may include the container on which the cap is attached, particularly, a squeezable container for storing contact lens cleaning and disinfecting solution.

BRIEF DESCRIPTION OF THE DRAWINGS

The present invention may be better understood with reference to the following detailed description when considered in conjunction with the accompanying drawings in which.

DETAILED DESCRIPTION

Figure 1:
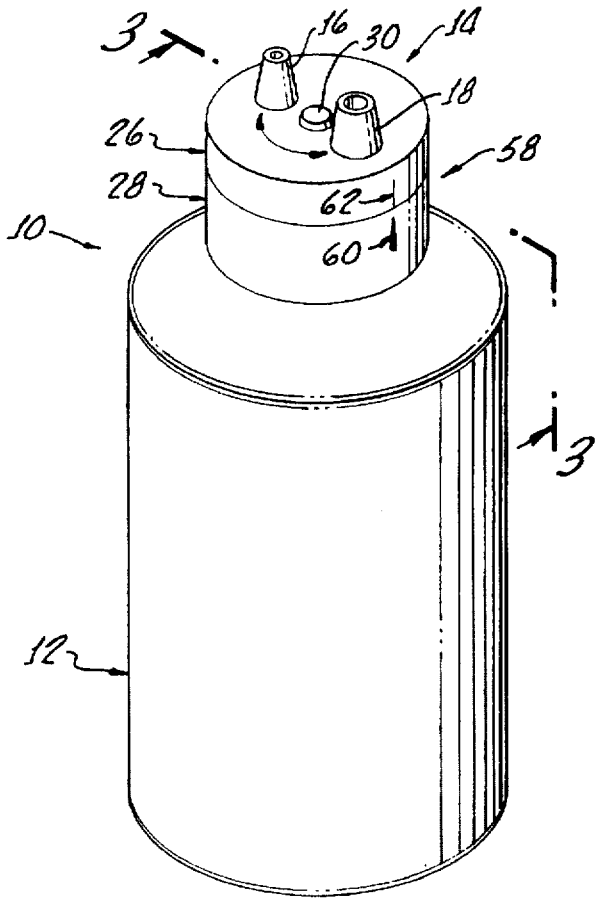
FIG. 1 shows a perspective view of an embodiment of the present invention, including two conical members for directing and dispensing fluid at two different rates of flow.
Figure 2:
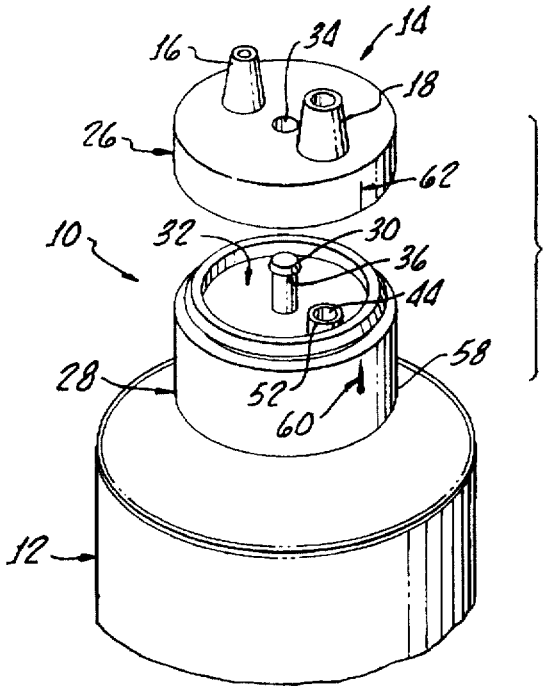
FIG. 2 shows an exploded perspective of the embodiment shown in FIG. 1.

Turning now to FIGS. 1 and 2, a multiflow dispensing cap 10 in accordance with the present invention is shown as connected to a container 12 for storing a fluid (not shown). It should be appreciated that in a broad sense, the present invention includes the container 12 as well.

Importantly, the present invention 10 includes nozzle means 14, including a plurality of conical members 16, 18, for both determining fluid flow rate from the cap 10 and for forming a directed stream of fluid from the cap 10 upon squeezing of the container 12. Although FIGS. 1 and 2 illustrate an embodiment of the present invention including two conical members 16, 18, it should be appreciated that more than two conical members may be provided.

Shown most clearly in FIG. 2, the nozzle means 14 is disposed on a top portion 26 of the cap 10, said top portion being rotatably mounted to a bottom portion 28 by means of a pin 30. The pin 30 is centrally located on said bottom portion 28, and protrudes therefrom. The top portion 26 includes a complementary aperture 34 for receiving the pin. A head 36 on the pin enables snap engagement between the top portion 26 and bottom portion 28 during assembly of the device 10 and provides a secure connection while enabling rotation of the top portion 26 with respect to the bottom portion 28. The pin 30 and the bottom portion 28 may be unitary in structure. The pin connection eliminates the need for more complicated structures for rotatable coupling between the top and bottom portions 26, 28.

Figure 3:
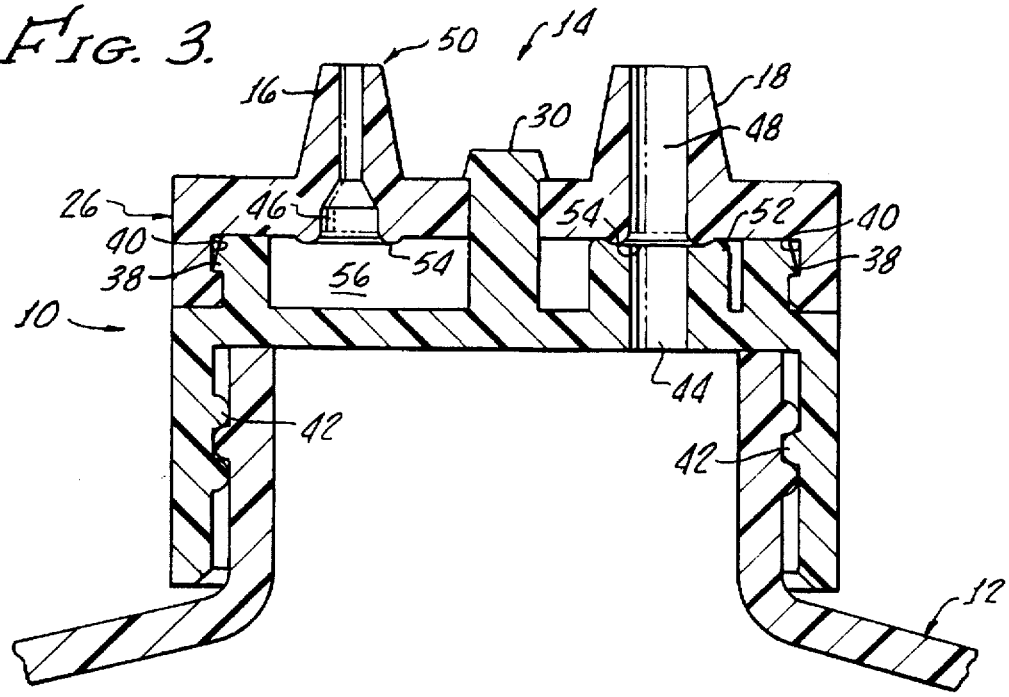
FIG. 3 shows a cross-sectional view of the present invention taken along line 3—3 of FIG. 1.

Referring now to FIG. 3, the means for rotatably mounting may further include a ring member 38 encircling the bottom portion 28, and a complementary groove 40 in the top portion 26 which provides means for engaging the ring member 38. This arrangement facilitates smooth rotation of the top portion 26 over a period of many uses.

The bottom portion 28 may include threads 42, or any other suitable mounting means, for attaching said bottom portion 28 to the container 12.

Referring now to FIGS. 2 and 3, it can be seen the bottom portion 28 includes means, defining an orifice 44 therein, for enabling fluid low therethrough. In other words, the orifice 44 is in fluid communication with the contents of the container 12. FIG. 3 illustrates the relationship between the bottom portion orifice 44 and the top portion nozzle means 14. Upon selection of a conical member suitable for the task at hand, a user will rotate the top portion 26 about the pin 30 until the selected conical member (in this illustration, conical member 18) is aligned with the bottom portion orifice 44. Thus aligned, fluid within the container 12 is able to flow through the conical member 18 by way of the bottom portion orifice 44.

Each conical member 16, 18 defines a flow passage 46, 48 respectively, which determines a particular direction and flow volume of a dispensed stream of fluid. In addition, preferably at least one of the conical members, such as conical member 16, includes a tip 50 having a size permitting the fluid to be dispensed in singular drops. Viscosity of the fluid to be dispensed will determine the size of the dropper tip 50. For example, for dispensing drops of fluid consisting of a contact lens cleaning solution, which may have the same viscosity as water, a relatively fine tip will be provided, in comparison to a fluid comprised of a more viscous liquid.

Although not shown, conceivably a variety of other conical member tips may be provided, for example, a perforated tip for dispensing fluid in a shower-like or mist fashion.

The present invention preferably comprises means for facilitating alignment and engagement between the selected conical member 18 and the bottom portion orifice 44. For example, a sealing collar 52 in the bottom portion 28 may be provided, as well as a complementary, doughnut-shaped seat 54 disposed peripherally about each flow passage 46, 48, and depending from each respective conical member 16, 18. The sealing collar 52 and peripheral seat 54 are configured to snap together upon proper alignment of the selected conical member 18 and the bottom portion orifice 44. Upon said proper alignment, the sealing collar 52 and peripheral seat 54 also provide a water tight seal which prevents fluid accumulation within a cavity 56 defined by the top 26 and bottom portion 28. Notably, in the event that there is fluid accumulation in the cavity 56, the ring member 38 and groove 40 arrangement, as hereinabove discussed, will provide a backup seal for preventing leakage of fluid out of the dispensing cap 10.

In order to further facilitate proper alignment of the selected conical member, 16, 18 with the bottom portion orifice 44, indicia means 58 may be provided as shown in FIGS. 1 and 2. More particularly, the bottom portion 28 may include a printed arrow 60 thereon which is adjacent the bottom portion orifice 44. On the top portion 26, adjacent each conical member 16, 18, is a complementary printed line 62 or other marking. Thus, upon selection of a certain conical member, such as conical member 18, a user will rotate the top portion 26 about the pin 30 until the line 62 corresponding to the selected conical member 18, and the arrow 60 are aligned as shown in FIG. 1. Notably, the arrow 60 and lines 62 may comprise raised surfaces such that they are both visible and palpable. Alternatively or additionally, the top portion 26 and bottom portion 28 may be configured such that upon proper alignment of a conical member 16, 18 with the bottom portion orifice 44, an audible snap engagement is perceived by the user.

Figure 4:
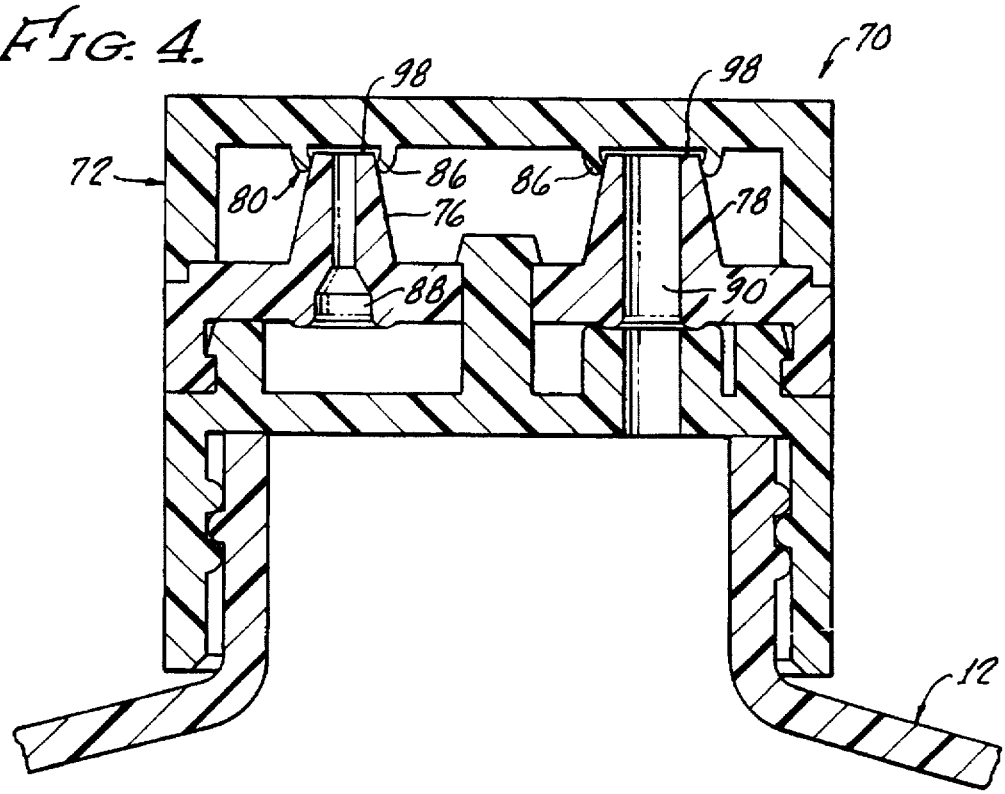
FIG. 4A shows a cross-sectional view of another embodiment of the present invention including a lid for preventing contamination of the nozzle means, said lid including shoulder means for preventing leakage of fluid between the conical members and the lid.

Another embodiment 70 of the present invention, shown in FIG. 4, includes a lid 72, removably engaged to the top portion 26 for preventing contamination of conical members 76, 78. In addition, the lid 72 may include shoulder means 80, depending therefrom and comprised of a plurality of annular members 86 that are shaped for engagement with the plurality of conical members 76, 78, for preventing leakage of fluid. In particular, the annular members 86 provide an airtight seal about the conical members 76, 78.

Preferably, each annular members 86 has identical dimensions with respect to each other annular member, such that each is configured to engage any one of the conical members 76, 78, in order to facilitate manual engagement of the lid 72 with the top portion 12. For the same reason, all of the conical members 76, 78 preferably have substantially identical outside dimensions, although the flow passages 88, 90 therein are each adapted for a particular dispensing task, as shown in FIG. 4. Consequently, a user will not be required to align a particular annular member 86 with a particular conical member 76, 78 when closing the lid 72 against the top portion 26.

Notably, the shoulder means 80 is adapted for preventing fluid leakage between the conical members 76, 78 and the lid 72 without contact with dispensing ends 98 of the conical members 16, 18.

The present invention may broadly include the container for storing a sterile solution, for example a contact lens solution such as ALLERGAN HYDROCARE®, ALLERGAN SORBI-CARE®, BLINK-N-CLEAN®, LENS FRESH®, or any of the contact lens rinsing, cleaning soaking and/or disinfecting solutions known in the art. Each conical member may be designed for a particular use, such as dispensing the sterile solution in a direct and precise stream or in single droplets. A user may desire to clean a contact lens and then apply a single drop of the same solution to the lens. The present invention provides an easy, hygienic device for accomplishing both tasks using a single container of solution.

Although there has been hereinabove described a multiple flow volume dispensing tip, in accordance with the present invention, for the purposes of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A multiflow dispensing cap comprising:

a bottom portion having means for attaching said bottom portion to a squeezable container and means, defining an orifice in said bottom portion, for enabling fluid flow therethrough upon squeezing of the container;

a top portion;

means for rotatably mounting said top portion to said bottom portion;

nozzle means, including a plurality of conical members, for both determining fluid flow rate from the dispensing cap and for forming a directed stream of fluid from the dispensing cap upon squeezing of the container, said nozzle means being disposed on said top portion for alignment of each conical member with the bottom portion orifice upon rotation of the top portion; and lid means, removably engaged to said top portion, for preventing contamination of the conical members, said lid means including shoulder means, depending therefrom, for preventing leakage of fluid between the conical members and the lid means without contact with dispensing ends of the conical members.

2. The multiflow dispensing cap according to claim 1 wherein the means for rotatably mounting includes a pin member disposed in said bottom portion and protruding therefrom.

3. The multiflow dispensing cap according to claim 2 wherein the means for rotatably mounting further includes a ring member encircling the bottom portion, and means, defining a complementary groove in the top portion, for engaging the ring member.

4. The multiflow dispensing cap according to claim 3 further comprising means, comprising a sealing collar in the bottom portion, for facilitating alignment and engagement between a selected conical member and the bottom portion orifice.

5. The multiflow dispensing cap according to claim 4 wherein the means for facilitating alignment and engagement further comprises a peripheral seat depending from each of said conical members.

6. The multiflow dispensing cap according to claim 5 further comprising indicia means, disposed on said top portion and said bottom portion, for indicating alignment of each one of said plurality of conical members with the bottom portion orifice.

7. The multiflow dispensing cap according to claim 1 wherein the shoulder means comprises a plurality of annular members each configured to engage any one of the conical members in order to facilitate manual engagement of the lid means with the top portion.

8. A multiflow dispensing device comprising:

a fluid;

container means for storing the fluid;

a bottom portion having means for attaching said bottom portion to the container means and means, defining an orifice in said bottom portion, for enabling fluid flow therethrough upon squeezing of the container means;

a top portion;

means for rotatably mounting said top portion to said bottom portion;

nozzle means, including a plurality of conical members, for both determining fluid flow rate from the dispensing cap and for forming a directed stream of fluid from the dispensing cap upon squeezing of the container, said nozzle means being disposed on said top portion for alignment of each conical member with the bottom portion orifice upon rotation of the top portion; and lid means, removably engaged to said top portion, for preventing contamination of the conical members, said lid means including shoulder means, depending therefrom, for preventing leakage of the fluid between the conical members and the lid means without contact with dispensing ends of the conical members.

9. The multiflow dispensing cap according to claim 8 wherein the means for rotatably mounting includes a pin member disposed in said bottom portion and protruding therefrom.

10. The multiflow dispensing cap according to claim 9 wherein the means for rotatably mounting further includes a ring member encircling the bottom portion, and means, defining a complementary groove in the top portion, for engaging the ring member.

11. The multiflow dispensing cap according to claim 10 further comprising means, comprising a sealing collar in the bottom portion, for facilitating alignment and engagement between a selected conical member and the bottom portion orifice.

12. The multiflow dispensing cap according to claim 11 wherein the means for facilitating alignment and engagement further comprises a peripheral seat depending from each of said conical members.

13. The multiflow dispensing device according to claim 8 wherein the shoulder means comprises a plurality of annular members each configured to engage any one of the conical members in order to facilitate manual engagement of the lid means with the top portion.

14. The multiflow dispensing device according to claim 13 wherein the fluid is a sterile contact lens cleaning solution.

15. The multiflow dispensing device according to claim 14 wherein at least one of said conical members includes a tip having a size permitting the contact lens cleaning solution to be dispensed in singular drops.

16. The multiflow dispensing device according to claim 8 further comprising indicia means, disposed on said top portion and said bottom portion, for indicating alignment of each one of said plurality of conical members with the bottom portion orifice.

17. A multiflow dispensing device comprising:

container means for storing a contact lens cleaning solution;

a bottom portion having means for attaching said bottom portion to the container means and means, defining an orifice in said bottom portion, for enabling fluid flow therethrough upon squeezing of the container means;

a top portion;

means for rotatably mounting said top portion to said bottom portion, said means for rotatably mounting including a pin member disposed in said bottom portion and protruding therefrom, a ring member encircling the bottom portion, and means, defining a complementary groove in the top portion for engaging the ring member;

nozzle means, including a plurality of conical members, for both determining fluid flow rate from the dispensing cap and for forming a directed stream of fluid from the dispensing cap upon squeezing of the container means, said nozzle means being disposed on said top portion for alignment of each conical member with the bottom portion orifice upon rotation of the top portion about the pin means, and at least one of said conical members including a tip having a size permitting the solution to be dispensed in singular drops;

means, for facilitating alignment and engagement between a selected conical member and the bottom portion orifice, said means for facilitating alignment and engagement comprising a sealing collar in the bottom portion and a peripheral seat depending from each of said conical members; and lid means, removably engaged to said top portion, for preventing contamination of the conical members, said lid means including shoulder means, depending therefrom, for preventing leakage of the contact lens cleaning solution between the conical members and the lid means without contact with dispensing ends of the conical members, wherein the shoulder means comprises a plurality of annular members each configured to engage any one of the conical members in order to facilitate manual engagement of the lid means with the top portion.

* * * * *